US005298339A

United States Patent [19]

Aghajanian et al.

[11] Patent Number: 5,298,339

[45] Date of Patent: Mar. 29, 1994

[54] ALUMINUM METAL MATRIX COMPOSITES

[75] Inventors: Michael K. Aghajanian; Marc S. Newkirk, both of Newark, Del.

[73] Assignee: Lanxide Technology Company, LP, Newark, Del.

[21] Appl. No.: 994,064

[22] Filed: Dec. 18, 1992

Related U.S. Application Data

[63] Continuation of Ser. No. 759,745, Sep. 12, 1991, abandoned, which is a continuation of Ser. No. 517,541, Apr. 24, 1990, abandoned, which is a continuation of Ser. No. 168,284, Mar. 15, 1988, abandoned.

[51] Int. Cl.[5] ..... C22C 1/10

[52] U.S. Cl. ..... 428/614; 428/650; 428/654

[58] Field of Search ..... 428/614, 650, 654

[56] References Cited

U.S. PATENT DOCUMENTS

| | | | |
|---|---|---|---|
| 2,951,771 | 9/1960 | Butler | 29/419.1 |
| 3,149,409 | 9/1964 | Maruhn | 92/222 |
| 3,547,180 | 12/1970 | Cochran et al. | 164/61 |
| 3,864,154 | 2/1975 | Gazza et al. | 428/539.5 |
| 3,970,136 | 7/1976 | Cannell et al. | 164/108 |
| 4,082,864 | 4/1978 | Kendall et al. | 427/255.2 |
| 4,232,091 | 11/1980 | Grimshaw | 428/472 |
| 4,376,803 | 3/1983 | Katzman | 428/408 |
| 4,376,804 | 3/1983 | Katzman | 428/408 |
| 4,404,262 | 9/1983 | Watmough | 428/539.5 |
| 4,450,207 | 5/1984 | Donomoto et al. | 428/614 |
| 4,473,103 | 9/1984 | Kenney et al. | 164/97 |
| 4,559,246 | 12/1985 | Jones | 427/299 |
| 4,570,316 | 2/1986 | Sakamaki et al. | 29/419.1 |
| 4,587,177 | 5/1986 | Toaz et al. | 428/614 |
| 4,630,665 | 12/1986 | Novak | 164/97 |
| 4,657,065 | 4/1987 | Wada et al. | 164/461 |
| 4,662,429 | 5/1987 | Wada et al. | 164/461 |
| 4,673,435 | 6/1987 | Yamaguchi et al. | 75/235 |
| 4,677,901 | 7/1987 | Ban et al. | 92/222 |
| 4,679,493 | 7/1987 | Munro et al. | 92/222 |
| 4,713,111 | 12/1987 | Cameron et al. | 75/68 R |
| 4,731,298 | 3/1988 | Shindo et al. | 428/611 |
| 4,752,537 | 6/1988 | Das | 428/654 |
| 4,753,690 | 6/1988 | Wada et al. | 148/11.5 A |
| 4,786,467 | 11/1988 | Skibo et al. | 428/614 |
| 5,154,984 | 10/1992 | Morita et al. | 428/614 |

FOREIGN PATENT DOCUMENTS

| | | | |
|---|---|---|---|
| 2819076 | 10/1979 | Fed. Rep. of Germany | 428/614 |
| 58-144441 | 8/1983 | Japan . | |

*Primary Examiner*—George Wyszomierski

*Attorney, Agent, or Firm*—Mark G. Mortenson; Kevin J. Boland

[57] ABSTRACT

The present invention relates to novel ceramic-filled metal matrix composites and methods for making the same. Particularly, a permeable mass of filler material is spontaneously infiltrated by, for example, an aluminum alloy, in the presence of nitrogen-containing atmosphere. A reservoir feeding technique for forming metal matrix composite bodies is also disclosed. The reservoir feeding technique can also be used to form complex (e.g., a metal bonded to a metal matrix composite) metal matrix composite bodies.

20 Claims, 1 Drawing Sheet

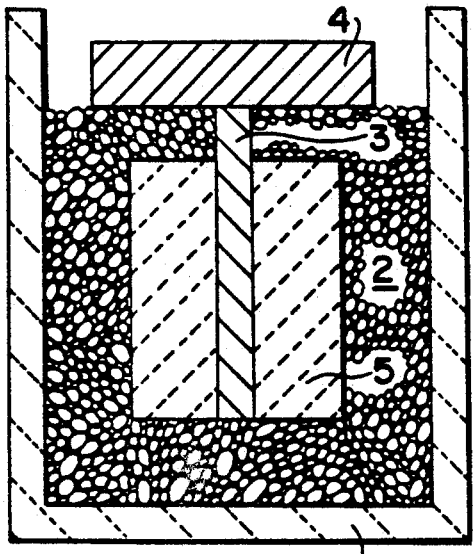
Fig. 1
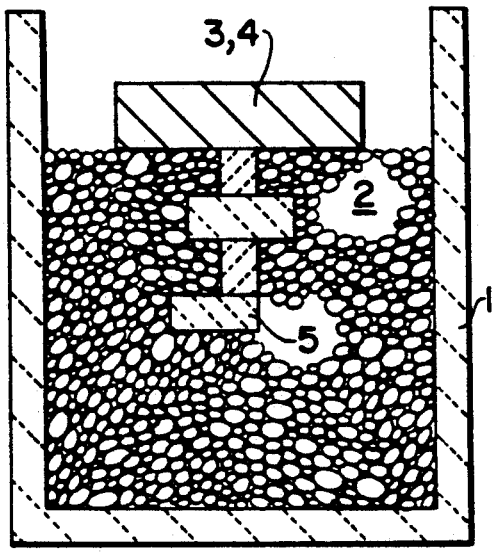
Fig. 2
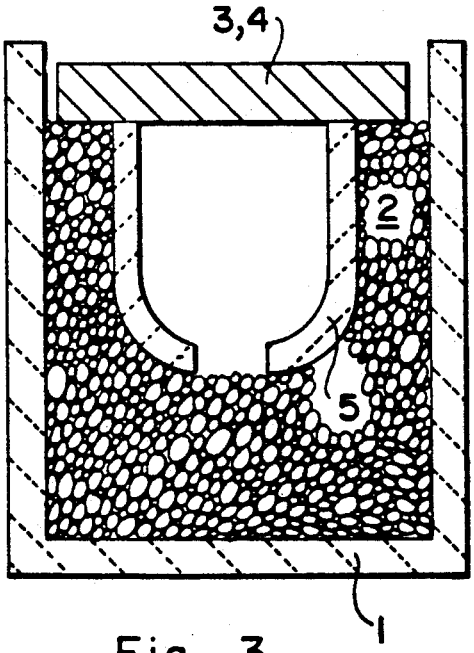
Fig. 3
Fig. 4
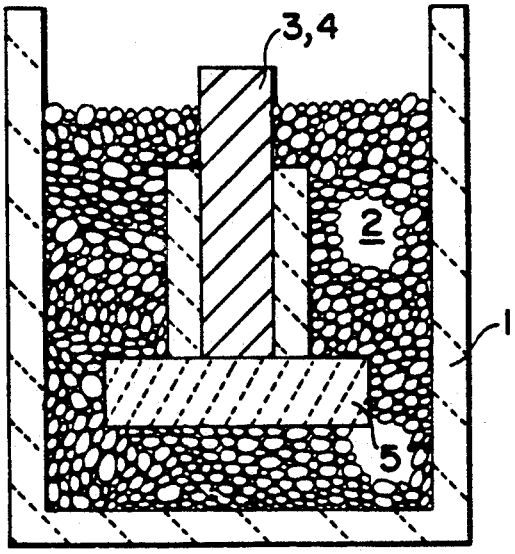

ALUMINUM METAL MATRIX COMPOSITES

This is a continuation of copending application(s) Ser. No. 07/759,745 filed on Sep. 12, 1991 which is a continuation of U.S. patent application Ser. No. 07/517,541, filed on Apr. 24, 1990, which is a continuation of U.S. patent application Ser. No. 07/168,284, filed on Mar. 15, 1988 (all abandoned).

FIELD OF THE INVENTION

The present invention relates to novel ceramic-filled metal matrix composites and methods for making the same. Particularly, a permeable mass of ceramic filler is spontaneously infiltrated (i.e., without the application of any applied pressure or vacuum) by a molten metal alloy, such as an aluminum alloy, in the presence of a nitrogen-containing atmosphere. Moreover, metal matrix composite bodies can be produced by using a reservoir feed method. Particularly, the metal is initially present as a first source and as a reservoir, the first source and reservoir communicating with each other such that a sufficient amount of metal is present to permeate completely the ceramic filler. Still further, if desirable, the reservoir can contain an excess amount of metal (i.e., more metal can be present than that amount which is needed for complete infiltration) and such excess metal can be bonded directly to the ceramic-filled metal matrix composite, thus forming a novel complex composite body comprising a metal bonded to a metal matrix composite body.

DESCRIPTION OF COMMONLY OWNED U.S. PATENT APPLICATIONS

The subject matter of this application is related to that of Commonly Owned U.S. Pat. No. 4,828,008, which issued on May 9, 1989, from U.S. patent application Ser. No. 049,171, filed May 13, 1987, in the name of White et al., and entitled "Metal Matrix Composites", the subject matter of which is herein incorporated by reference. According to the method of the White et al. invention, a metal matrix composite is produced by infiltrating a permeable mass of ceramic filler or ceramic-coated filler with molten aluminum containing at least about 1% by weight magnesium, and preferably at least about 3% by weight magnesium. Infiltration occurs spontaneously without the application of external pressure or vacuum. A supply of the molten metal alloy is contacted with the mass of filler material at a temperature of at least about 675° C. in the presence of a gas comprising from about 10 to 100%, and preferably at least about 50%, nitrogen by volume, and a remainder of the gas being a nonoxidizing gas, e.g., argon. Under these conditions, the molten aluminum alloy infiltrates the ceramic mass under normal atmospheric pressures to form an aluminum matrix composite. When the desired amount of ceramic material has been infiltrated with molten alloy, the temperature is lowered to solidify the alloy, thereby forming a solid metal matrix structure that embeds the reinforcing ceramic material. Usually, and preferably, the supply of molten alloy delivered will be sufficient to permit the infiltration to proceed essentially to the boundaries of the ceramic mass. The amount of ceramic filler in the aluminum matrix composites produced according to the White et al. invention may be exceedingly high. In this respect, filler to alloy volumetric ratios of greater than 1:1 may be achieved.

Under the process conditions in the aforesaid White et al. invention, aluminum nitride can form as a discontinuous phase dispersed throughout the aluminum matrix. The amount of nitride in the aluminum matrix may vary depending on such factors as temperature, alloy composition, gas composition, and ceramic filler. Thus, by controlling one or more such factors in the system, it is possible to tailor certain properties of the composite. For some end use applications, however, it is desirable that the composite contain little or substantially no aluminum nitride.

It has been observed that higher temperatures favor infiltration but render the process more susceptible to nitride formation. The White et al. invention achieves a good balance between infiltration kinetics and minimal nitride formation.

The reservoir feeding of a molten metal has been successfully utilized to produce a ceramic matrix composite structure. Particularly, as disclosed in Commonly Owned U.S. Pat. No. 4,900,699, which issued on Feb. 13, 1990, from U.S. patent application Ser. No. 908,067, filed Sep. 16, 1986, in the names of Newkirk et al, and entitled "Reservoir Feed Method of Making Ceramic Composite Structures and Structures Made Thereby" (and published in the EPO on Mar. 30, 1988 as U.S. Pat. No. 0,262,075), the reservoir feed method has been successfully applied in ceramic matrix structures. The subject matter of U.S. patent Ser. No. 908,067, is herein incorporated by reference.

According to the method of the Newkirk et al. invention, the composite body which is produced comprises a self-supporting ceramic composite structure which includes a ceramic matrix obtained by the oxidation reaction of a parent metal with an oxidant to form a polycrystalline material. In conducting the process, a body of the parent metal and a permeable filler are oriented relative to each other so that formation of the oxidation reaction product will occur in a direction toward and into the filler. The parent metal is described as being present as a first source and as a reservoir, the reservoir of metal communicating with the first source due to, for example, gravity flow. The first source of molten parent metal reacts with the oxidant to begin the formation of the oxidation reaction product. As the first source of molten parent metal is consumed, it is replenished, preferably by a continuous means, from the reservoir of parent metal as the oxidation reaction product continues to be produced and infiltrates the filler. Thus, the reservoir assures that ample parent metal will be available to continue the process until the oxidation reaction product has grown to a desired extent.

Thus, analogously in the present invention, the resulting composite product can be a metal matrix composite surface on a metal substrate. The metal matrix embeds a filler at a surface of the first source of metal, and the resulting metal matrix composite may be formed either as an exterior or an interior surface, or both, on the substrate of the metal. The metal matrix composite surface can have a selected or predetermined thickness with respect to the metal substrate. Thus, the techniques disclosed in the Newkirk et al. invention of replenishing parent metal by use of a reservoir can be adapted to the preparation of thick wall or thin wall metal matrix composite structures, in which the relative volumes of the metal matrix providing these metal matrix composite surfaces are substantially larger or smaller than the volume of precursor metal substrate. Additionally, if it is desired, the finished product may have the metal substrate completely, or partially removed, or the metal substrate may be left intact.

BACKGROUND OF THE INVENTION

Composite products comprising a metal matrix and a strengthening or reinforcing phase such as ceramic particulates, whiskers, fibers or the like, show great promise for a variety of applications because they combine some of the stiffness and wear resistance of the reinforcing phase with the ductility and toughness of the metal matrix. Generally, a metal matrix composite will show an improvement in such properties as strength, stiffness, contact wear resistance, and elevated temperature strength retention relative to the matrix metal in monolithic form, but the degree to which any given property may be improved depends largely on the specific constituents, their volume or weight fraction, and how they are processed in forming the composite. In some instances, the composite also may be lighter in weight than the matrix metal per se. Aluminum matrix composites reinforced with ceramics such as silicon carbide in particulate, platelet, or whisker form, for example, are of interest because of their higher stiffness, wear resistance and high temperature strength relative to aluminum.

Various metallurgical processes have been described for the fabrication of aluminum matrix composites, including methods based on powder metallurgy techniques and liquid-metal infiltration techniques which make use of pressure casting, vacuum casting, stirring, and wetting agents. With powder metallurgy techniques, the metal in the form of a powder and the reinforcing material in the form of a powder, whiskers, chopped fibers, etc., are admixed and then either cold-pressed and sintered, or hot-pressed. The maximum ceramic volume fraction in silicon carbide reinforced aluminum matrix composites produced by this method has been reported to be 25 volume percent in the case of whiskers, and 40 volume percent in the case of particulates.

The production of metal matrix composites by powder metallurgy techniques utilizing conventional processes imposes certain limitations with respect to the characteristics of the products attainable. The volume fraction of the ceramic phase in the composite is limited typically to about 40 percent. Also, the pressing operation poses a limit on the practical size attainable. Only relatively simple product shapes are possible without subsequent processing (e.g., forming or machining) or without resorting to complex presses. Also, nonuniform shrinkage during sintering can occur, as well as nonuniformity of microstructure due to segregation in the compacts and grain growth.

U.S. Pat. No. 3,970,136, granted Jul. 20, 1976, to J. C. Cannell et al., describes a process for forming a metal matrix composite incorporating a fibrous reinforcement, e.g. silicon carbide or alumina whiskers, having a predetermined pattern of fiber orientation. The composite is made by placing parallel mats or felts of coplanar fibers in a mold with a reservoir of molten matrix metal, e.g., aluminum, between at least some of the mats, and applying pressure to force molten metal to penetrate the mats and surround the oriented fibers. Molten metal may be poured onto the stack of mats while being forced under pressure to flow between the mats. Loadings of up to about 50% by volume of reinforcing fibers in the composite have been reported.

The above-described infiltration process, in view of its dependence on outside pressure to force the molten matrix metal through the stack of fibrous mats, is subject to the vagaries of pressure-induced flow processes, i.e., possible non-uniformity of matrix formation, porosity, etc. Non-uniformity of properties is possible even though molten metal may be introduced at a multiplicity of sites within the fibrous array. Consequently, complicated mat/reservoir arrays and flow pathways need to be provided to achieve adequate and uniform penetration of the stack of fiber mats. Also, the aforesaid pressure-infiltration method allows for only a relatively low reinforcement to matrix volume fraction to be achieved because of difficulty of infiltrating a large mat volume. Still further, molds are required to contain the molten metal under pressure, which adds to the expense of the process. Finally, the aforesaid process, limited to infiltrating aligned particles or fibers, is not directed to formation of aluminum metal matrix composites reinforced with materials in the form of randomly oriented particles, whiskers or fibers.

In the fabrication of aluminum matrix-alumina filled composites, aluminum does not readily wet alumina, thereby making it difficult to form a coherent product. Various solutions to this problem have been suggested. One such approach is to coat the alumina with a metal (e.g., nickel or tungsten), which is then hot-pressed along with the aluminum. In another technique, the aluminum is alloyed with lithium, and the alumina may be coated with silica. However, these composites exhibit variations in properties, or the coatings can degrade the filler, or the matrix contains lithium which can affect the matrix properties.

U.S. Pat. No. 4,232,091 to R. W. Grimshaw et al., overcomes certain difficulties in the art which are encountered in the production of aluminum matrix-alumina composites. This patent describes applying pressures of 73–375 kg/cm$^2$ to force molten aluminum (or molten aluminum alloy) into a fibrous or whisker mat of alumina which has been preheated to 700° to 1050° C. The maximum volume ratio of alumina to metal in the resulting solid casting was 0.25/1. Because of its dependency on outside force to accomplish infiltration, this process is subject to many of the same deficiencies as that of Cannell et al.

European Patent Application Publication No. 115,742 describes making aluminum-alumina composites, especially useful as electrolytic cell components, by filling the voids of a preformed alumina matrix with molten aluminum. The application emphasizes the nonwettability of alumina by aluminum, and therefore various techniques are employed to wet the alumina throughout the preform. For example, the alumina is coated with a wetting agent of a diboride of titanium, zirconium, hafnium, or niobium, or with a metal, i.e., lithium, magnesium, calcium, titanium, chromium, iron, cobalt, nickel, zirconium, or hafnium. Inert atmospheres, such as argon, are employed to facilitate wetting. This reference also shows applying pressure to cause molten aluminum to penetrate an uncoated matrix. In this aspect, infiltration is accomplished by evacuating the pores and then applying pressure to the molten aluminum in an inert atmosphere, e.g., argon. Alternatively, the preform can be infiltrated by vapor-phase aluminum deposition to wet the surface prior to filling the voids by infiltration with molten aluminum. To assure retention of the aluminum in the pores of the preform, heat treatment, e.g., at 1400° to 1800° C., in either a vacuum or in argon is required. Otherwise, either exposure of the pressure infiltrated material to gas or removal of the infiltration pressure will cause loss of aluminum from the body.

The use of wetting agents to effect infiltration of an alumina component in an electrolytic cell with molten metal is also shown in European Patent Application Publication No. 94353. This publication describes production of aluminum by electrowinning with a cell having a cathodic current feeder as a cell liner or substrate. In order to protect this substrate from molten cryolite, a thin coating of a mixture of a wetting agent and solubility suppressor is applied to the alumina substrate prior to start-up of the cell or while immersed in the molten aluminum produced by the electrolytic process. Wetting agents disclosed are titanium, zirconium, hafnium, silicon, magnesium, vanadium, chromium, niobium, or calcium, and titanium is stated as the preferred agent. Compounds of boron, carbon and nitrogen are described as being useful in suppressing the solubility of the wetting agents in molten aluminum. The reference, however, does not suggest the production of metal matrix composites, nor does it suggest the formation of such a composite in a nitrogen atmosphere.

In addition to application of pressure and wetting agents, it has been disclosed that an applied vacuum will aid the penetration of molten aluminum into a porous ceramic compact. For example, U.S. Pat. No. 3,718,441, granted Feb. 27, 1973, to R. L. Landingham, reports infiltration of a ceramic compact (e.g., boron carbide, alumina and beryllia) with either molten aluminum, beryllium, magnesium, titanium, vanadium, nickel or chromium under a vacuum of less than $10^{-6}$ torr. A vacuum of $10^{-2}$ to $10^{-6}$ torr resulted in poor wetting of the ceramic by the molten metal to the extent that the metal did not flow freely into the ceramic void spaces. However, wetting was said to have improved when the vacuum was reduced to less than $10^{-6}$ torr.

U.S. Pat. No. 3,864,154, granted Feb. 4, 1975, to G. E. Gazza et al., also shows the use of vacuum to achieve infiltration. This patent describes loading a cold-pressed compact of $AlB_{12}$ powder onto a bed of cold-pressed aluminum powder. Additional aluminum was then positioned on top of the $AlB_{12}$ powder compact. The crucible, loaded with the $AlB_{12}$ compact "sandwiched" between the layers of aluminum powder, was placed in a vacuum furnace. The furnace was evacuated to approximately $10^{-5}$ torr to permit outgassing. The temperature was subsequently raised to 1100° C. and maintained for a period of 3 hours. At these conditions, the molten aluminum genetrated the porous $AlB_{12}$ compact.

U.S. Pat. No. 3,364,976, granted Jan. 23, 1968 to John N. Reding et al., discloses the concept of creating a self-generated vacuum in a body to enhance penetration of a molten metal into the body. Specifically, it is disclosed that a body, e.g., a graphite mold, a steel mold, or a porous refractory material, is entirely submerged in a molten metal. In the case of a mold, the mold cavity, which is filled with a gas reactive with the metal, communicates with the externally located molten metal through at least one orifice in the mold. When the mold is immersed into the melt, filling of the cavity occurs as the self-generated vacuum is produced from the reaction between the gas in the cavity and the molten metal. Particularly, the vacuum is a result of the formation of a solid oxidized form of the metal. Thus, Reding et al. disclose that it is essential to induce a reaction between gas in the cavity and the molten metal. However, utilizing a mold to create a vacuum is undesirable because of the inherent limitations associated with use of a mold. Molds must first be machined into a particular shape; then finished, machined to produce an acceptable casting surface on the mold; then assembled prior to their use; then disassembled after their use to remove the cast piece therefrom; and thereafter reclaim the mold, which most likely would include refinishing surfaces of the mold. Machining of a mold into a complex shape can be very costly and time-consuming. Moreover, removal of a formed piece from a complex-shaped mold can also be difficult (i.e., cast pieces having a complex shape could be broken when removed from the mold). Still further, while there is a suggestion that a porous refractory material can be immersed directly in a molten metal without the need for a mold, the refractory material would have to be an integral piece because there is no provision for infiltrating a loose or separated porous material absent the use of a container mold (i.e., the particulate material would typically disassociate or float apart when placed in a molten metal). Still further, if it was desired to infiltrate a particulate material or loosely formed preform, the infiltrating metal would probably displace at least portions of the particulate or preform resulting in a non-homogeneous microstructure.

Accordingly, there has been a long felt need for a simple and reliable process to produce metal matrix composites which does not rely upon the use of applied pressure, vacuum, whether externally applied or internally created, or damaging wetting agents to create a metal matrix embedding a ceramic material. Thus, the present invention satisfies this need by providing a spontaneous infiltration mechanism for infiltrating a ceramic material with molten aluminum alloys under atmospheric pressure so long as certain processing criteria are satisfied. Moreover, the present invention also provides a simple and economical solution to the persistent problem of bonding a metal to a metal matrix composite body, thus forming a complex composite body.

SUMMARY OF THE INVENTION

The present method can be utilized to produce a metal matrix composite by infiltrating a permeable mass of ceramic filler or ceramic-coated filler with molten aluminum containing at least about 1% by weight magnesium, and preferably at least about 3% by weight magnesium. Infiltration occurs spontaneously (i.e., without the need for the application of an external pressure or a high vacuum). A supply of the molten aluminum is contacted with the mass of filler material at a temperature of at least about 700° C. in the presence of a gas comprising from about 10 to 100%, by volume, and preferably at least about 50% nitrogen, by volume, the balance being a nonoxidizing gas such as argon. The matrix metal alloy is present as a first source of metal and as a reservoir of matrix metal alloy which is communicating with the first source of molten metal due to, for example, gravity flow. Particularly, under the above-described conditions, the first source of molten aluminum alloy begins to infiltrate the ceramic mass under normal atmospheric pressures to begin the formation of an aluminum matrix composite. The first source of molten metal alloy is consumed during its infiltration into the ceramic mass and, if desired, can be replenished, preferably by a continuous means, from the reservoir of molten metal as the spontaneous infiltration continues. When a desired amount of permeable filler has been spontaneously infiltrated by the molten alloy, the temperature is lowered to solidify the alloy, thereby forming a solid metal matrix structure that embeds the reinforcing ceramic material. (It should be understood that the use of a reservoir of parent metal is simply one embodiment of the invention and it is not necessary to combine the reservoir embodiment with each of the alternate embodiments of the invention disclosed herein).

The reservoir of metal can be present in an amount such that it provides for a sufficient amount of metal to infiltrate the permeable ceramic mass to a predetermined extent. Alternatively, an optional barrier means can contact the permeable ceramic mass on at least one side thereof to define a surface boundary. The barrier means is used to inhibit, prevent or terminate infiltration of the molten alloy thereby providing net, or near net, shapes in the resultant metal matrix composite. Moreover, while the supply of molten alloy delivered should be at least sufficient to permit spontaneous infiltration to proceed essentially to the boundaries (i.e., barriers) of the permeable ceramic mass, the amount of alloy present in the reservoir could exceed such sufficient amount so that not only will there be a sufficient amount of alloy for complete infiltration, but excess molten metal alloy could remain. Thus, when excess molten alloy is present, the resulting body will be a complex composite body, wherein an infiltrated ceramic body having an aluminum matrix therein will be directly bonded to excess matrix metal remaining in the reservoir.

Generally, the present invention provides not only significant processing advantages in producing self-supporting metal matrix composite structures, but enables the production of novel complex composite bodies, namely, metal matrix composite surfaced metal structures, in which the metal matrix composite surface is formed from the metal infiltrated ceramic mass. That is, the matrix metal infiltrates the ceramic mass and because the infiltrated matrix is integral with the metal, the resulting composite product comprises a metal matrix composite surface on a metal substrate. The metal matrix composite surface includes a filler, and the metal matrix surface may be formed either as an exterior or an interior surface, or both, on a substrate of the metal, and the metal matrix composite surface may be of a selected or a predetermined thickness with respect to the metal substrate. These techniques of the present invention of replenishing matrix metal enable the preparation of thick wall or thin wall metal matrix composite structures, in which the relative volume of metal matrix providing the metal matrix composite surface is substantially larger or smaller than the volume of metal substrate. If desired in the finished product, the metal substrate may be completely or partially removed, or it may be left intact.

The techniques of the present invention also enable the production of a series of metal matrix composite structures from a common source of matrix metal, thus considerably enhancing efficiency of operation.

In another aspect of the present invention, a metal matrix composite surfaced metal substrate part is provided wherein said substrate is bonded to the metal matrix composite on the surface.

In a further aspect of the present invention, a metal matrix composite surfaced metal substrate part is provided wherein the metal matrix composite surface is in compression and the metal substrate is in tension at the interface between the two.

In a still further aspect of the present invention, an optional nitride skin can be grown on an outer surface of the infiltrated metal matrix. Such skin can be grown due to prolonged exposure of the molten metal alloy to the nitrogen atmosphere. It may be desirable to form such a skin to improve the wear resistance of the composite body.

BRIEF DESCRIPTION OF THE DRAWINGS

The following drawings are provided to assist in understanding the invention, but are not intended to limit the scope thereof. Similar reference numerals have been used wherever possible in each of the Figures to denote like components, wherein:

FIG. 1 is a cross-sectional view of a lay-up according to the invention wherein a cut-away crucible preform is embedded in a bedding material and wherein the preform is in contact with a reservoir of matrix metal;

FIG. 2 is a cross-sectional view of a lay-up according to the invention, wherein a portion of a camshaft is embedded in a bedding material and a portion of the camshaft is in intimate contact with a reservoir of matrix metal;

FIG. 3 is a cross-sectional view of a lay-up according to the invention, wherein a crucible with a cut-away bottom portion is embedded in a bedding metal and the preform is in intimate contact with a reservoir of matrix metal.

FIG. 4 is a cross-sectional view of a lay-up according to the invention, wherein a gear-like preform is embedded in a bedding material and the gear-like preform is in intimate contact with a reservoir of matrix metal.

DETAILED DISCUSSION OF PREFERRED EMBODIMENTS

In accordance with the method of this invention, a first source of an aluminum-magnesium matrix metal alloy is positioned such that it is in communication with a surface of a permeable mass of ceramic material (e.g., ceramic particles, whiskers, or fibers) so that when the aluminum-magnesium alloy is in the molten stage, it can spontaneously infiltrate the permeable mass of ceramic material. Moreover, a reservoir of matrix metal is in communication with the first source of matrix metal alloy so that the reservoir matrix metal flows to replenish, and in some cases to provide initially and subsequently replenish, that portion, segment or source of matrix metal which has infiltrated into the permeable mass of ceramic material, such infiltration occurring in the presence of a nitrogen-containing gas spontaneously and progressively. A barrier means such as titanium diboride or a graphite tape product by Union Carbide, and known by the name Grafoil®, may optionally be provided to define or coincide with at least one surface of the permeable mass of ceramic material, thereby defining an exterior surface of the composite body to be formed.

Under the conditions employed in the method of the present invention, the ceramic mass or body is sufficiently permeable to permit a nitrogen-containing gas to penetrate the body and contact the molten metal. Moreover, the permeable ceramic mass or body can accommodate infiltration of the molten metal, thereby causing the nitrogen-permeated ceramic mass to be infiltrated spontaneously with the molten metal alloy to form a metal matrix composite body. The extent of spontaneous infiltration and formation of the metal matrix will vary with a given set of process conditions, including magnesium content of the aluminum alloy, the presence of additional alloying elements (e.g., silicon, iron, copper, manganese, chromium, zinc, and the like), size of the filler material particles, surface condition and type of filler material, nitrogen concentration of the gas, time permitted for infiltration and temperature at which infiltration occurs. For infiltration of the molten aluminum alloy to occur spontaneously, the aluminum is alloyed with at least about 1% by weight, and preferably at least about 3% by weight, magnesium, based on alloy weight. Auxiliary alloying elements, as discussed above, may also be included in the alloy to tailor specific properties thereof. (Additionally, the auxiliary alloying elements may affect the minimum amount of magnesium that is necessary to result in spontaneous infiltration of the permeable mass.) Volatilization of magnesium, etc., can be a problem. Thus, it is desirable to utilize a sufficient amount of initial alloying elements to assure that spontaneous infiltration will not be affected by volatilization. Additionally, the volume percent of nitrogen in the nitrogen atmosphere also affects formation rates of the metal matrix composite body. Specifically, if less than about 10 volume percent of nitrogen is present in the atmosphere, very slow or little spontaneous infiltration will occur. It has been discovered that it is preferable for at least about 50 volume percent of nitrogen to be present in the atmosphere, thereby resulting in, for example, shorter infiltration times due to a much more rapid rate of infiltration.

In accord with the invention, the matrix metal in the reservoir could be of a composition exactly the same as the first source of matrix metal or could be quite different in composition. In fact, so long as the metal in the reservoir is miscible with or soluble in the first source of matrix metal, then the different metal could be utilized in this process. Such a different metal, when present as residual metal in a complex composite body, could be used to modify physical and/or chemical properties of the first source of matrix metal to, for example, increase the melting point of the first source, increase the corrosion resistance of the first source, etc.

While the presence of a reservoir of metal assures complete infiltration, in some cases it may be desirable to remove any metal which is in excess of the amount needed to result in complete infiltration of the permeable ceramic mass. However, in other cases it may be desirable to have an excess amount of reservoir metal remaining in the resultant product. For example, in a body which contains an excess reservoir of metal, there would exist a very desirable and strong physical bond between the reservoir metal and the formed metal matrix composite body. Thus, a complex composite comprising a metal bonded to a metal matrix composite body would result.

The minimum magnesium content of the aluminum alloy useful in producing a ceramic filled metal matrix composite depends on one or more variables such as the processing temperature, time, the presence of auxiliary alloying elements such as silicon or zinc, the nature of the ceramic filler material, and the nitrogen content of the gas stream. Lower temperatures or shorter heating times can be used to obtain complete infiltration as the magnesium content of the alloy is increased. Also, for a given magnesium content, the addition of certain auxiliary alloying elements such as zinc permits the use of lower temperatures. For example, a magnesium content at the lower end of the operable range, e.g., from about 1 to 3 weight percent, may be used in conjunction with at least one of the following: an above-minimum processing temperature, a high nitrogen concentration, or one or more auxiliary alloying elements. Alloys containing from about 3 to 5 weight percent magnesium are preferred on the basis of their general utility over a wide variety of process conditions, with at least about 5% being preferred when lower temperatures and shorter times are employed. Magnesium contents in excess of about 10% by weight of the aluminum alloy may be employed to moderate the temperature conditions required for infiltration. The magnesium content may be reduced when used in conjunction with an auxiliary alloying element, but these elements serve an auxiliary function only and are used together with the above-specified amount of magnesium. For example, there was substantially no infiltration of nominally pure aluminum alloyed only with 10% silicon at 1000° C. into a bedding of 500 mesh, 39 Crystolon (99% pure silicon carbide from Norton Co.).

It is also noted that it may be possible to apply the auxiliary alloying element(s) on a surface of the alloy prior to infiltrating the alloy into the permeable mass or into the permeable mass itself. Particularly, the alloying element of magnesium could be externally applied as a dopant of, for example, Mg, magnesium nitride (e.g., $Mg_3N_2$), etc., on the surface of the first matrix metal source which is closest to, or preferably in contact with, the permeable mass of ceramic material; or such dopants could be mixed into at least a portion of the permeable mass of ceramic material. Still further, it is possible that some combination of external doping and placement of dopants into at least a portion of the permeable mass of ceramic material could be used. Such external application of a magnesium source material as a dopant could result in a decrease in the total weight percent of magnesium needed to promote infiltration of the parent metal aluminum alloy into the permeable ceramic mass, as well as achieving lower temperatures at which infiltration can occur. The use of one or more auxiliary alloying elements and the concentration of nitrogen in the surrounding gas also affects the extent of nitriding of the alloy matrix at a given temperature. For example, increasing the concentration of an auxiliary alloying element such as zinc or iron in the alloy, or placed on a surface of the alloy, may be used to reduce the infiltration temperature and thereby decrease the nitride formation, whereas increasing the concentration of nitrogen in the gas may be used to promote nitride formation.

The concentration of magnesium in the alloy, or doped onto a surface of the alloy, also tends to affect the extent of infiltration at a given temperature. Consequently, it is preferred that at least about three weight percent magnesium be included in the alloy. Alloy contents of less than this amount, such as one weight percent magnesium, tend to require higher process temperatures or an auxiliary alloying element for infiltration. The temperature required to effect the spontaneous infiltration process of this invention may be lower: (1) when the magnesium content of the alloy is increased, e.g. to at least about 5 weight percent; (2) when dopants are mixed with the permeable mass of ceramic material; and/or (3) when another element such as zinc or iron is present in the aluminum alloy. The temperature also may vary with different ceramic materials. In general, spontaneous and progressive infiltration will occur at a process temperature of at least about 675° C., and preferably a process temperature of at least about 800° C.

Temperatures generally in excess of 1200° C. do not appear to benefit the process, and a particularly useful temperature range has been found to be about from 675° C. to 1200° C.

In the present method, molten aluminum alloy is delivered to a mass of permeable ceramic material in the presence of a nitrogen-containing gas maintained for the entire time required to achieve infiltration. This is accomplished by maintaining a continuous flow of gas into contact with the lay-up of ceramic material and molten aluminum alloy. Although the flow rate of the nitrogen-containing gas is not critical, it is preferred that the flow rate be sufficient to compensate for any nitrogen lost from the atmosphere due to nitride formation in the alloy matrix, and also to prevent or inhibit the incursion of air which can have an oxidizing effect on the molten metal.

The method of this invention is applicable to a wide variety of ceramic materials, and the choice of filler material will depend on such factors as the aluminum alloy, the process conditions, the reactivity of the molten aluminum with the filler material, and the properties sought for the final composite product. These materials include (a) oxides, e.g. alumina, magnesia, titania, zirconia and hafnia; (b) carbides, e.g. silicon carbide and titanium carbide; (c) borides, e.g. titanium diboride, aluminum dodecaboride, and (d) nitrides, e.g. aluminum nitride, silicon nitride, and zirconium nitride. If there is a tendency for the filler material to react with the molten aluminum alloy, this might be accommodated by minimizing the infiltration time and temperature or by providing a non-reactive coating on the filler. The filler material may comprise a substrate, such as carbon or other non-ceramic material, bearing a ceramic coating to protect the substrate from attack or degradation. Suitable ceramic coatings include the oxides, carbides, borides and nitrides. Ceramics which are preferred for use in the present method include alumina and silicon carbide in the form of particles, platelets, whiskers and fibers. The fibers can be discontinuous (in chopped form) or in the form of continuous filament, such as multifilament tows. Further, the ceramic mass or preform may be homogeneous or heterogeneous.

Silicon carbide reacts with molten aluminum to form aluminum carbide, and if silicon carbide is used as the filler material, it is desirable to prevent or minimize this reaction. Aluminum carbide is susceptible to attack by moisture, which potentially weakens the composite. Consequently, to minimize or prevent this reaction, the silicon carbide is prefired in air to form a reactive silica coating thereon, or the aluminum alloy is further alloyed with silicon, or both. In either case, the effect is to increase the silicon content in the alloy to eliminate the aluminum carbide formation. Similar methods can be used to prevent undesirable reactions with other filler materials.

Moreover, it has been discovered that certain filler materials exhibit enhanced infiltration relative to filler materials having a similar chemical composition. For example, crushed alumina bodies made by the method disclosed in U.S. Pat. No. 4,713,360, the subject matter of which is herein expressly incorporated by reference, exhibit desirable infiltration properties relative to a commercially available alumina product. Specifically, it has been discovered that complete infiltration of a permeable mass of ceramic material can occur at lower infiltration temperatures and/or lower infiltration times by utilizing a crushed or comminuted body produced by the method of the aforementioned U.S. Patent.

The size and shape of the ceramic material can be any that may be required to achieve the properties desired in the composite. Thus, the material may be in the form of particles, whiskers, platelets or fibers since infiltration is not restricted by the shape of the filler material. Other shapes such as spheres, tubules, pellets, refractory fiber cloth, and the like may be employed. In addition, the size of the material does not limit infiltration, although a higher temperature or longer time period may be needed for complete infiltration of a mass of smaller particles than for larger particles. Further, the mass of ceramic material to be infiltrated is permeable, i.e., permeable to molten aluminum alloys and to nitrogen-containing gases. The ceramic material can be either at its pour density or compressed to a greater density.

The method of the present invention, not being dependent on the use of pressure to force or squeeze molten metal into a mass of ceramic material, permits the production of substantially uniform aluminum alloy matrix composites having a high volume fraction of ceramic material and low porosity. Higher volume fractions of ceramic material may be achieved by using a lower porosity initial mass of ceramic material. Higher volume fractions also may be achieved if the ceramic mass is compacted under pressure provided that the mass is not converted into either a compact with closed cell porosity or into a fully dense structure that would prevent infiltration by the molten alloy.

It has been observed that for aluminum infiltration and matrix formation with a given aluminum alloy/-ceramic system, wetting of the ceramic by the aluminum alloy is the predominant infiltration mechanism. At low processing temperatures, a negligible or minimal amount of metal nitriding occurs resulting in a minimal discontinuous phase of aluminum nitride dispersed in the metal matrix. However, as the upper end of the temperature range is approached, nitridation of the metal is more likely to occur. Thus, the amount of the nitride phase in the metal matrix can be controlled by varying the processing temperature at which infiltration occurs. The specific process temperature at which nitride formation becomes more pronounced also varies with such factors as the aluminum alloy used and its quantity relative to the volume of filler, the ceramic material to be infiltrated, and the nitrogen concentration of the gas used. For example, the extent of aluminum nitride formation at a given process temperature is believed to increase as the ability of the alloy to wet the ceramic filler decreases and as the nitrogen concentration of the gas increases.

It is therefore possible to tailor the constituency of the metal matrix during formation of the composite to impart certain characteristics to the resulting product. For a given system, the process temperature can be selected to control the nitride formation. A composite product containing an aluminum nitride phase will exhibit certain properties which can be favorable to, or improve the performance of, the product. Further, the temperature range for spontaneous infiltration with aluminum alloy may vary with the ceramic material used. In the case of alumina as the filler material, the temperature for infiltration should preferably not exceed about 1000° C. in order to insure that the ductility of the matrix is not reduced by the significant formation of any nitride. However, temperatures exceeding 1000° C. may be employed if it is desired to produce a composite with a less ductile and stiffer matrix. To infiltrate other ceramics such as silicon carbide, higher temperatures of about 1200° C. may be employed since the aluminum alloy nitrides to a lesser extent, relative to the use of alumina as filler, when silicon carbide is employed as a filler material.

Moreover, it is possible to utilize a matrix metal in the reservoir which differs composition from the first source of matrix metal. For example, if an aluminum alloy is used as the first source of matrix metal, then virtually any other metal or metal alloy which was molten at the processing temperature could be used as the reservoir metal. Molten metals frequently are very miscible with each other which would result in the reservoir metal mixing with the first source of matrix metal so long as an adequate amount of time is given for the mixing to occur. Thus, by using a reservoir metal which is different in composition than the first source of matrix metal, it is possible to tailor the properties of the metal matrix to meet various operating requirements and thus tailor the properties of the metal matrix composite.

In accordance with another embodiment of the invention, the composite is provided with an aluminum nitride skin or surface. Generally, the amount of the alloy is sufficient to infiltrate essentially the entire bed of ceramic material, that is, to the defined boundaries. However, if the supply of molten alloy is exhausted prior to the entire bed or preform being infiltrated, and the temperature has not been reduced to solidify the alloy, an aluminum nitride layer or zone may form on or along the outer surface of the composite due to nitriding of the surface regions of the infiltrating front of aluminum alloy. That portion of the bed not embedded by the matrix is readily removed, if desired, as by grit blasting. Also, a nitride skin can be formed at the surface of the bed or preform infiltrated to its boundary by prolonging the process conditions. For example, an open vessel which is nonwettable by the molten aluminum alloy is filled with the permeable ceramic filler, and the top surface of the ceramic bed is exposed to the nitrogen gas. Upon metal infiltration of the bed to the vessel walls and top surface, if the temperature and flow of nitrogen gas are continued, the molten aluminum at the exposed surface will nitride. The degree of nitridation can be controlled, and may be formed as either a continuous phase or a discontinuous phase in the skin layer. It therefore is possible to tailor the composite for specific applications by controlling of the extent of nitride formation on the surface of the composite. For example, aluminum matrix composites bearing a surface layer of aluminum nitride may be produced exhibiting improved wear resistance relative to the metal matrix.

As is shown in the following examples, molten aluminum-magnesium alloys spontaneously infiltrate a permeable mass of ceramic material due to their tendency to wet a ceramic material permeated with nitrogen gas. Auxiliary alloying elements such as silicon and zinc may be included in the aluminum alloys to permit the use of lower temperatures and lower magnesium concentrations. Aluminum-magnesium alloys which include 10–20% or more of silicon therein are preferred for infiltrating unfired silicon carbide since silicon tends to minimize reaction of the molten alloy with silicon carbide to form aluminum carbide. In addition, the aluminum alloys employed in the invention may include various other alloying elements to provide specifically desired mechanical and physical properties in the alloy matrix. For example, copper additives may be included in the alloy to provide a matrix which may be heat treated to increase hardness and strength.

With regard to the drawings, similar reference numerals have been used throughout each of FIGS. 1–4 to represent similar articles. Specifically, the numeral 1 represents a refractory container, the numeral 2 represents an inert bedding or barrier material of Grade HTC titanium diboride, the numeral 3 represents a first source of matrix metal, the numeral 4 represents a reservoir of matrix metal and the numeral 5 represents a permeable mass of ceramic material (e.g., a ceramic preform) into which a molten metal spontaneously infiltrates.

FIG. 1 shows a typical setup wherein a permeable mass of ceramic material 5 (in this case shaped into a preform) is in contact with a first source of matrix metal 3. It is clear from FIG. 1, even though not drawn exactly to scale, that the amount of matrix metal contained in the first source of matrix metal is not sufficient to infiltrate completely the preform 5. Thus, a reservoir source of matrix, metal 4, is in contact with the first souce of matrix metal 3 thus providing communication therebetween. Particularly, at infiltration temperatures, the first source of matrix metal is plenished by the reservoir of matrix metal 4 to permit complete infiltration of the preform 5. Moreover, it is possible to feed excess matrix metal from the reservoir to result in a complex composite body. Particularly, as discussed above herein, the complex composite body comprises a matrix metal substrate surrounded by a metal matrix composite.

FIG. 2 shows generally a reservoir feed metal matrix composite embodiment wherein an aluminum alloy 3, 4 spontaneously infiltrates a ceramic preform 5. The composition of the aluminum alloy was about 83% aluminum, 5% silicon, 5% zinc, and 7% magnesium, by weight. The ceramic preform was prepared by slipcasting a camshaft. The composition of the slip was about 70% A-17 $Al_2O_3$ from ALCOA and about 30 weight percent EPK (Edgars Plastic Kaolin). The slipcast part was prepared by combining powder components with a predetermined quantity of water containing Veegum CER. The Kaolin clay was added to the water first, followed by alumina powder. The slurry was mixed at a high sheer rate for about one hour and then rolled in a jar on a pair of rollers overnite (e.g., about 10 hours) to age it. Casting was conducted in Plaster of Paris molds which were shaped appropriately. After the preforms were cast and released, they were dried for about two hours in an oven at about 90° C. It was then necessary to prefire these pieces at a temperature of about 700°–1300° C. to impart sufficient strength for handling purposes. The resulting porosity in the pieces was about 35% by volume.

The slipcast and fired part was then placed into a a grade HTC $TiB_2$ bedding material purchased from Union Carbide. The $TiB_2$ functioned as a barrier material into which the aluminum alloy would not grow after complete infiltration into the ceramic preform 5 had occurred. The combination of bedding material 2, ceramic preform 5, and aluminum alloy 3, 4 were held in an alumina crucible having a purity of 99.9%. The entire assembly was then placed into a closed atmosphere electric furnace and heated to a temperature at which the aluminum alloy became molten. Table 1 shows specific conditions which existed when Samples 1–4, which corresponded to the setup shown in FIG. 2, were made. It is clear from Table 1 that for a common ramping temperature of about 150° C. per hour and an ultimate dwelling temperature within the range of 825°-875° C. for a period of time of 10 hours-30 hours and in the presence of a mixed atmosphere of hydrogen and nitrogen, flowing at a rate of 500 cc/minute, that infiltration into the preform 5 occurred with success.

TABLE 1

| Sample No. | Alloy | Barrier Material | Ramp | Dwell Temp/Time | Atmosphere $H_2/N_2$ | Infiltration |
|---|---|---|---|---|---|---|
| 1 | Al—5Si—5Zn—7Mg | $TiB_2$ Grade HTC | 150° C./hr | 875/12 hrs | 500 cc/min | yes |
| 2 | Al—5Si—5Zn—7Mg | $TiB_2$ Grade HTC | 150° C./hr | 875/24 hrs | 500 cc/min | yes |
| 3 | Al—5Si—5Zn—7Mg | $TiB_2$ Grade HTC | 150° C./hr | 875/10 hrs<br>825/20 hrs | 500 cc/min | yes |
| 4 | Al—5Si—5Zn—7Mg | $TiB_2$ Grade HTC | 150° C./hr | 875/20 hrs<br>825/20 hrs | 500 cc/min | yes |
| 5 | Al—3Si—5Mg | $TiB_2$ Grade HTC | 150° C./hr | 875/10 hrs | 500 cc/min | yes |
| 6 | Al—3Si—5Mg | $TiB_2$ Grade HTC | 150° C./hr | 880/18 hrs | 600 cc/min | yes |

The result in each of Samples 1-4 was that a permeable ceramic mass was spontaneously infiltrated by the molten aluminum alloy and the amount of alloy present was in excess of that which was necessary to infiltrate completely the permeable ceramic preform, such that a remaining amount of metal was present. Thus, the composite body comprised a complex composite body comprising a metal bonded to a metal matrix composite, wherein the metal portion of the metal body was substantially equivalent in composition to the composition of the starting alloy. It is, of course, possible to remove the alloy portion of the resulting composite body by subsequent treatments. However, in some cases, it may be desirable to form a complex composite body, wherein excess metal is integral with a metal matrix composite body.

FIG. 3 shows another example of a reservoir feeding technique according to the present invention. In this example, the alloy used was slightly different from the alloy used in Samples 1-4. Particularly, the alloy 3,4 was about 92% by weight aluminum, 3% by weight silicon, and about 5% by weight magnesium. The specific forming conditions are shown in detail in Table 1 under Sample No. 5. In this case, the ceramic preform 5 (i.e., a crucible 5 having a hole in its bottom portion) was sediment cast from a slurry comprising about 70% by weight 220 mesh 38 -Alundum; from Norton Co. about 30% by weight 500 mesh 38-Alundum with about 3% by weight 325 mesh silicon metal added thereto. The crucible 5 was sediment-cast by standard techniques and then prefired at about 1300° C. for 3 hours. The wall of the crucible 5 had a thickness of about 2 mm and an outer diameter of about 4 cm. Additionally, the height of the crucible 5 was about 4 cm. Thus, as shown in Table 1, infiltration of the aluminum alloy into the ceramic crucible 5 was again successful.

Table 1 also shows the result of Sample No. 6, wherein an alloy similar to the alloy used in Sample No. 5 was utilized. Moreover, as shown in FIG. 4, the ceramic preform 5 was differently shaped and made of a different composition than any of the previous ceramic preforms. Particularly, in this case the ceramic preform 5 was formed into a gear-like structure and was made of C-75 Alumina from Alcon with 10 weight percent Elmer's Glue added as a binder, the entire assembly being sediment cast by a standard technique and prefired at a sufficient temperature to impart sufficient strength for handling purposes. Once again, as shown in Table 1, infiltration of the aluminum alloy 3, 4 into the preform 5 occurred successfully.

While the preceding examples have been described with a certain degree of particularity, modifications to these examples should occur to an artisan of ordinary skill, and all such modifications should be considered to be within the scope of the claims appended thereto.

What is claimed is:

1. A complex composite article comprising:

(a) at least one filler material embedded by a matrix comprising an aluminum matrix metal, said at least one filler material containing at least some aluminum nitride on a surface thereof at least said matrix metal being three dimensionally interconnected about said filler material, thereby forming a predominantly metal matrix composite body; and (b) a body of metal contacting at least a portion of said metal matrix composite body, said body of metal being integrally bonded to said metal matrix composite body to form a complex composite article.

2. The complex composite article of claim 1, wherein said filler material comprises at least one material selected from the group consisting of oxides, carbides, borides, and nitrides.

3. The complex composite article of claim 1, wherein said filler material comprises at least one material selected from the group consisting of alumina, magnesia, titania, zirconia, hafnia, silicon carbide, titanium carbide, titanium diboride, aluminum dodecaboride, aluminum nitride, silicon nitride and zirconium nitride.

4. The complex composite article of claim 1, wherein said filler material comprises at least one material selected from the group consisting of particles, platelets, whiskers, spheres, tubules, pellets, refractory fiber cloth, and fibers.

5. The complex composite article of claim 1, wherein said body of metal has a composition which is different from said matrix metal.

6. The complex composite article of claim 5, wherein said body of metal has a greater corrosion resistance than said matrix metal.

7. The complex composite article of claim 5, wherein said body of metal has a higher melting point than said matrix metal.

8. The complex composite article of claim 1, wherein said metal matrix composite body comprises a surface on said body of metal.

9. The complex composite article of claim 1, wherein said body of metal comprises a surface on said metal matrix composite body.

10. The complex composite article of claim 1, wherein said metal matrix composite body sandwiches said body of metal.

11. The complex composite article of claim 1, wherein at least a portion of a surface of said metal matrix composite body comprises an aluminum nitride skin.

12. The complex composite article of claim 1, wherein said matrix metal comprises aluminum and at least one alloying constituent comprising at least one material selected from the group consisting of magnesium, silicon, iron, copper, manganese, chromium and zinc.

13. The complex composite article of claim 1, wherein said body of metal and said matrix metal have substantially the same composition.

14. The complex composite article of claim 1, wherein said at least some aluminum nitride has been formed in situ during formation of said complex composite article.

15. A complex composite article comprising:

(a) at least one filler material comprising at least one material selected from the group consisting of particles, platelets, whiskers, spheres, tubules, pellets, refractory fiber cloth, and fibers, said filler material being embedded by a matrix comprising an aluminum matrix metal , said at least one filler material containing at least some aluminum nitride on a surface thereof, at least said matrix metal being three dimensionally interconnected about said filler material, thereby forming a predominantly metal matrix composite body; and (b) a body of metal contacting at least a portion of said metal matrix composite body, said body of metal being integrally bonded to said metal matrix composite body to form a complex composite article.

16. The complex composite article of claim 15, wherein said matrix metal comprises an aluminum-magnesium alloy.

17. The complex composite article of claim 15, wherein said matrix metal comprises aluminum and at least one alloying constituent comprising at least one material selected from the group consisting of magnesium, silicon, iron, copper, manganese, chromium and zinc.

18. The complex composite article of claim 15, wherein said at least some aluminum nitride has been formed in situ during formation of said complex composite article.

19. A complex composite article comprising:

(a) at least one filler material embedded by a matrix comprising matrix metal and at least some aluminum nitride formed in situ, said matrix metal comprising aluminum, at least said matrix metal being three-dimensionally interconnected about said filler material, thereby forming a predominantly metal matrix composite body;

(b) a body of metal contacting at least a portion of said metal matrix composite body, said body of metal being integrally bonded to said metal matrix composite body to form a complex composite article; and (c) wherein at least a portion of a surface of said metal matrix composite body comprises an aluminum nitride skin.

20. The complex composite article of claim 19, wherein said at least one filler material comprises at least one material selected from the group consisting of particles, platelets, whiskers, spheres, tubules pellets, refractory fiber cloth, and fibers.

* * * * *